US007992526B2

(12) United States Patent
Ritsema et al.

(10) Patent No.: US 7,992,526 B2
(45) Date of Patent: Aug. 9, 2011

(54) CONDENSING WATER HEATER

(75) Inventors: Ryan Ritsema, Middleville, MI (US); Michael W. Gordon, East Grand Rapids, MI (US)

(73) Assignee: Bradford White Corporation, Ambler, PA (US)

( * ) Notice: Subject to any disclaimer, the term of this patent is extended or adjusted under 35 U.S.C. 154(b) by 624 days.

(21) Appl. No.: 12/134,702

(22) Filed: Jun. 6, 2008

(65) Prior Publication Data

US 2009/0301406 A1 Dec. 10, 2009

(51) Int. Cl.
*F24D 17/00* (2006.01)

(52) U.S. Cl. ..... 122/18.3; 122/15.1; 122/32

(58) Field of Classification Search ..... 122/15.1, 122/18.1, 18.2, 18.3, 32
See application file for complete search history.

(56) References Cited

U.S. PATENT DOCUMENTS

| | | | | | |
|---|---|---|---|---|---|
| 4,557,220 | A * | 12/1985 | Jannemann et al. | ..... | 122/20 B |
| 4,846,150 | A * | 7/1989 | Maton | ..... | 122/18.2 |
| 5,699,756 | A * | 12/1997 | Ross et al. | ..... | 122/18.3 |
| 7,354,244 | B2 * | 4/2008 | Hasbargen et al. | ..... | 415/212.1 |
| 2002/0014233 | A1 * | 2/2002 | Gatley, Jr. et al. | ..... | 126/110 R |
| 2004/0011301 | A1 | 1/2004 | Gordon et al. | | |
| 2006/0065211 | A1 | 3/2006 | Hasbargen et al. | | |
| 2009/0165733 | A1 * | 7/2009 | Ferguson | ..... | 122/18.3 |
| 2010/0043728 | A1 * | 2/2010 | Ma et al. | ..... | 122/18.3 |

* cited by examiner

*Primary Examiner* — Gregory A Wilson
(74) *Attorney, Agent, or Firm* — RatnerPrestia

(57) ABSTRACT

A flue system is provided for a water heater having improved heat exchange efficiency. The flue system includes an upstream heat exchange portion providing a first pass for heat exchange with water in the water heater. The flue system further includes a downstream heat exchange portion providing a second pass for heat exchange with water in the water heater and a blower positioned between the upstream heat exchange portion and the downstream heat exchange portion. The blower is configured to urge combustion products from the upstream heat exchange portion to the downstream heat exchange portion.

34 Claims, 10 Drawing Sheets

CONDENSING WATER HEATER

FIELD OF THE INVENTION

The present invention relates to a high efficiency water heater and, more particularly, to a water heater having improved heat exchange performance.

BACKGROUND OF THE INVENTION

Commercial and residential water heaters typically heat water by generating tens of thousands, and even hundreds of thousands, of BTUs. For many years, manufacturers of water heaters have sought to increase the efficiency of the exchange of this heat energy from burned fuel to the water contained in the water heater. Accordingly, maximized heat exchange efficiency has long been an object of commercial and residential water heater manufacturers.

As heat exchange efficiency increases, however, such increased efficiency gives rise to the problems associated with condensation of water vapor from the products of combustion. More specifically, upon burning of a mixture of fuel and air, water is formed as a constituent of the products of combustion. It is recognized that as the temperatures of the combustion gases decrease as the result of successful exchange of heat from the combustion gases to water in the water heater, the water vapor within the combustion gases tends to be condensed in greater quantities. In other words, as the temperatures of the combustion gases decrease as a direct result of increasingly efficient exchange of heat energy to water, the amount of condensate forming on the heat exchange surfaces also increases.

Such condensate is typically acidic, with pH values often in the range of between about 2 to 5. The formation of increased amounts of such acidic condensate, even in relatively small quantities, can accelerate the corrosion of heat exchange tubing, increase oxidation and scale formation, reduce heat exchange efficiency and contribute to failure of the water heater.

Commercial and residential water heaters can be designed to operate below the efficiencies at which increased quantities of condensate are likely to form (i.e., below the condensing mode) so that acidic products of combustion are discharged in vapor form in higher temperature exhaust gas. To do so, however, compromises the efficiency of the water heater.

Accordingly, there continues to be a need for a water heater having improved heat exchange efficiency yet resisting the effects of water vapor condensation associated with such efficiency.

SUMMARY OF THE INVENTION

In one exemplary embodiment, this invention provides a water heater having improved heat exchange efficiency. The water heater includes a water tank and a flue system extending at least partially through an interior of the water tank and positioned to receive combustion products and to transfer heat from combustion products within the flue system to water in the water tank. The flue system includes an upstream heat exchange portion providing a first pass for heat exchange with water in the water tank. The flue system further includes a downstream heat exchange portion providing a second pass for heat exchange with water in the water tank, and a blower positioned between the upstream heat exchange portion and the downstream heat exchange portion. The blower is configured to urge the combustion products from the upstream heat exchange portion to the downstream heat exchange portion.

In another exemplary embodiment, a flue system is provided. The flue system includes an upstream heat exchange portion providing a first pass for heat exchange with water in the water heater. The flue system further includes a downstream heat exchange portion providing a second pass for heat exchange with water in the water heater and a blower positioned between the upstream heat exchange portion and the downstream heat exchange portion.

In yet another exemplary embodiment, a method of improving heat exchange efficiency of a water heater is provided. The method comprises the step of positioning a blower between an upstream heat exchange portion positioned at least partially within the water storage tank, and a downstream heat exchange portion positioned at least partially within the water storage tank. The combustion products are induced to flow from a combustion chamber of the water heater into the upstream heat exchange portion for exchanging heat between the combustion products and the water in the water storage tank. The combustion products are then delivered through a downstream heat exchange portion to exchange heat between the combustion products and the water in the water storage tank.

In still another exemplary embodiment, a water heater having improved heat exchange efficiency is provided. The water heater comprises a water tank and a flue system extending at least partially through an interior of the water tank and positioned to receive combustion products and to transfer heat from the combustion products within the flue system to water in the water tank. A blower is positioned outside of the water tank and downstream of the flue system. The blower is configured to urge the combustion products from the flue system. A thermal insulator is positioned over at least a portion of the blower for thermally insulating the blower.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features are arbitrarily expanded or reduced for clarity. Included in the drawings are the following figures.

DETAILED DESCRIPTION OF THE PREFERRED EMBODIMENTS

Figure 1:
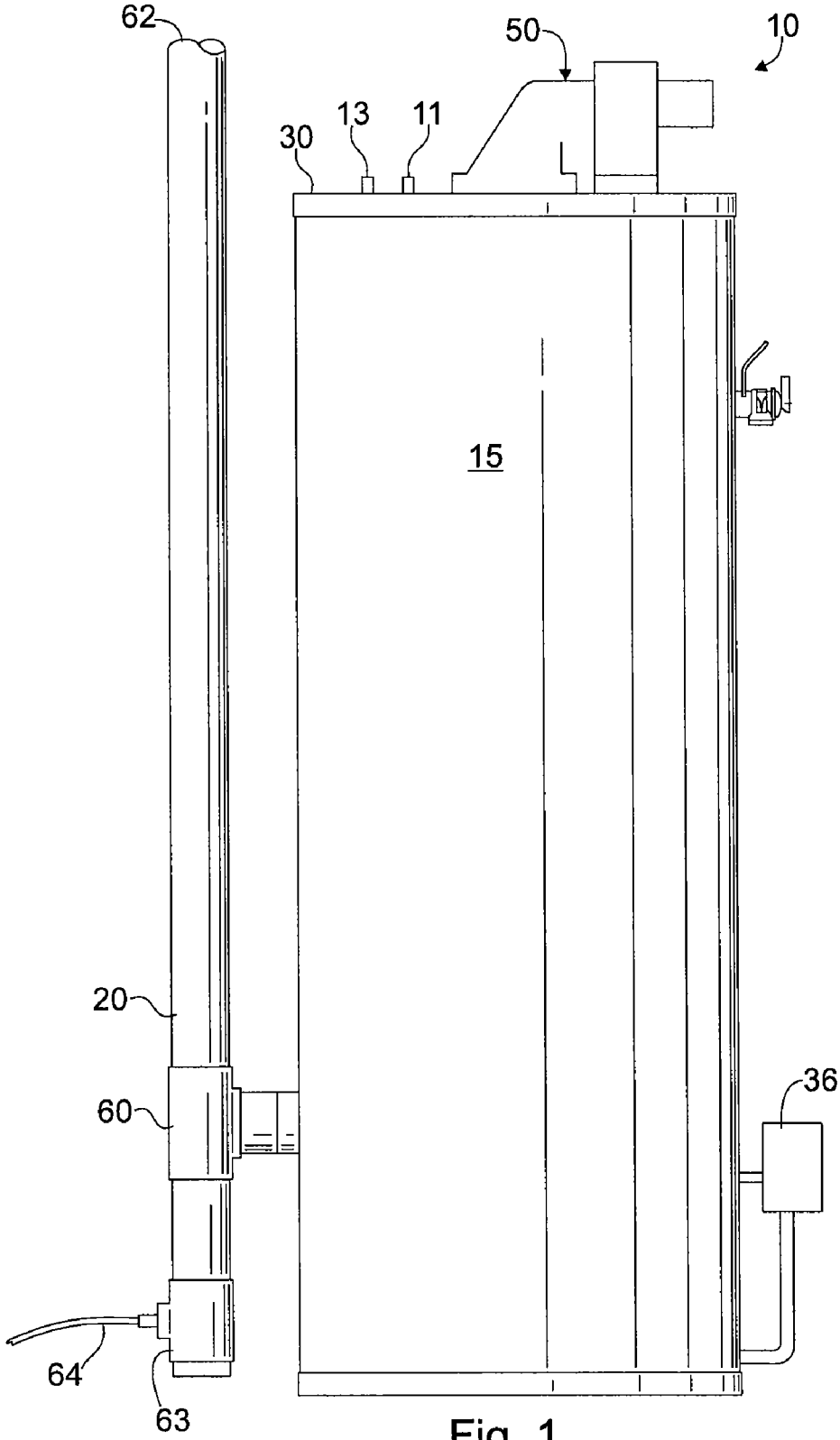
FIG. 1 is a side elevation view of an exemplary embodiment of a water heating system according to aspects of this invention.

Exemplary features of selected embodiments of this invention will now be described with reference to the figures. It will be appreciated that the spirit and scope of the invention is not limited to the embodiments selected for illustration. Also, it should be noted that the drawings are not rendered to any particular scale or proportion. It is contemplated that any of the exemplary configurations and materials and sizes described hereafter can be modified within the scope of this invention.

Referring generally to the figures and according to one exemplary embodiment of the invention, this invention provides a water heater 15 having improved heat exchange efficiency. The water heater 15 includes a water tank 22 and a flue system 50 extending at least partially through an interior of the water tank 22 and positioned to receive combustion products and to transfer heat from the combustion products within the flue system 50 to water in the water tank 22. The flue system 50 includes an upstream heat exchange portion 32 providing a first pass for heat exchange with water in the water tank 22. The flue system 50 further includes a downstream heat exchange portion 34 providing a second pass for heat exchange with water in the water tank, and a blower 54 positioned between the upstream heat exchange portion 32 and the downstream heat exchange portion 34. The blower 54 is configured to urge the combustion products from the upstream heat exchange portion 32 to the downstream heat exchange portion 34.

Figure 2:
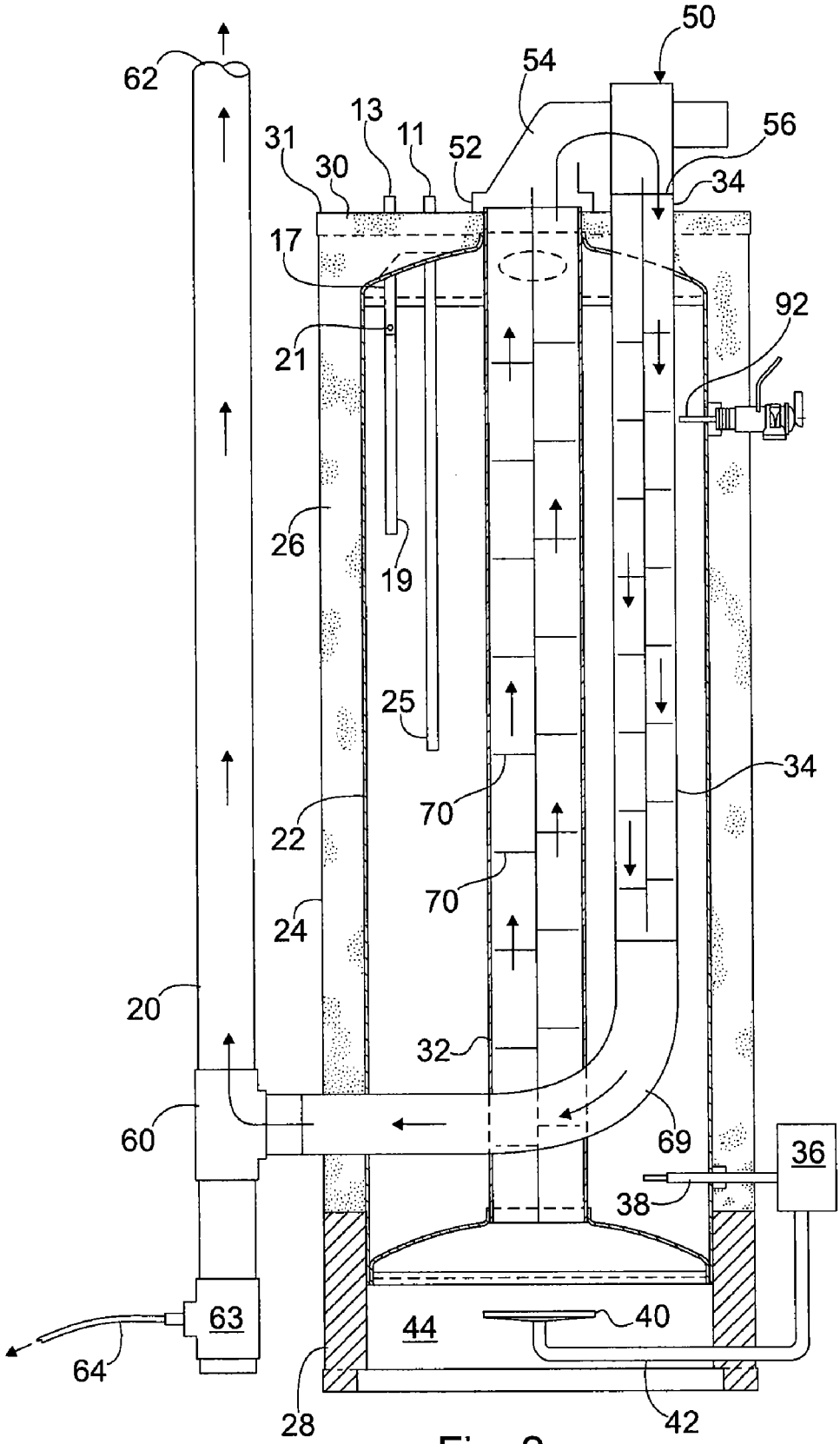
FIG. 2 is a partial cross-sectional side elevation view of the water heater illustrated in FIG. 1.

Referring now to FIGS. 1 and 2, a residential water heating system embodying exemplary aspects of this invention is generally designated by the numeral "10." In the residential water heating system, a gas-fired water heater 15 is attached to a gas supply line (not shown) and an exhaust conduit 20. The gas supply line supplies natural gas to the water heater 15 for combustion, and the exhaust conduit 20 provides a conduit for exhausting the products of combustion from the water heater 15.

The gas-fired water heater 15 comprises a water tank 22 for containing water, an outer shell 24 for encapsulating the water tank 22, and an annular cavity formed between the water tank 22 and the outer shell 24. Foam insulation 26 and an insulation member 28 are provided in the annular cavity to limit the escapement of thermal energy from the water storage tank 22 to the surrounding environment. A top cover 30 is fastened to the outer shell 24, thereby enclosing the top surface of the water storage tank 22. The top cover 30 includes apertures for accommodating a flue system 50, a cold water inlet port 11 and a hot water outlet port 13.

Although not shown, the cold water inlet port 11 is coupled to an unheated water supply line. In practice, unheated water is introduced into the water heater 15 through the cold water inlet port 11. An inlet diptube 25 is coupled to the inlet port 11 and positioned within the water tank 22 for delivering unheated water into the bottom end of the water tank 22.

The outlet port 13 of the water heater 15 is coupled to a heated water supply line (not shown) for distributing heated water from the tank 22. An outlet diptube 17 is coupled to an opposing end of the outlet port 13 and positioned within the water tank 22. The outlet dip tube 17 includes a circular inlet port 21 for drawing heated water from the top end of the water tank 22. The heated water is ultimately distributed through the heated water supply line to one or more hot water distribution points. A sacrificial anode rod 19 is coupled to the end of the outlet diptube 17. The anode rod 19 is configured for limiting corrosion of the metallic water tank 22.

According to this exemplary embodiment, the water heater 15 is gas-fired. As will be appreciated by those skilled in the art, the invention disclosed herein is not limited to gas-fired water heaters. Many of the details of this invention may also apply to any other type of heat exchanger or insulated tank. Furthermore, although reference is made to "residential" water heaters, the descriptions herein also apply to industrial, commercial or domestic water heaters as well as other heat transfer systems.

The gas-fired water heater 15 includes a control unit 36 having a gas valve and thermostat. The control unit 36 includes an inlet (not shown) for receiving gas from a gas supply line (not shown). A thermocouple 38 extending from the control unit 36 measures the water temperature inside the water tank 22. Apertures are provided in the outer shell 24 and the water tank 22 to accommodate the thermocouple 38. In operation, the control unit 36 compares the temperature reported by the thermocouple 38 with the temperature setting of the thermostat (set by the user) and adjusts the amount of gas provided to a gas burner 40 accordingly.

The gas burner 40 receives gas via a conduit 42. The gas burner 40 is positioned in a combustion chamber 44 that is disposed at an elevation beneath the water storage tank 22. A pilot is positioned adjacent the gas burner 40 within the combustion chamber 44 for igniting the gas. The products of combustion are carried along a flue system 50 that is positioned at least partially within the interior of the tank 22. The combustion products are ultimately exhausted through an exhaust conduit 20. Although the gas burner 40 and the combustion chamber 44 are positioned at an elevation beneath the water tank 22, they may also be positioned at an elevation above the water tank 22, or at any other desired elevation.

Thermal energy is generated within the combustion chamber 44 for distribution to the contents of the water storage tank 22. The flue system 50 is configured to transfer the thermal energy from the products of combustion emanating from the combustion chamber 44 to the water contained within the tank 22. Arrows in FIG. 2 indicate the flow of combustion products through the heat exchange system.

Generally, the flue system 50 illustrated in the figures is a so-called "two pass" heat exchanger in which the combustion products make two passes through the water to be heated, thereby exchanging heat to the water in each of the two passes. In this particular embodiment, the first pass of combustion products through an upstream heat exchange portion 32 (also referred to as "upstream portion 32") provides for the primary heat exchange and the second pass of combustion products through a downstream heat exchange portion 34 (also referred to as "downstream portion 34") provides for the secondary heat exchange.

More particularly, the flue system 50 includes an upstream heat exchange portion 32 providing a first pass for heat exchange with water in the water tank 22, a downstream heat exchange portion 34 providing a second pass for heat exchange with water in the water tank 22, and an air blower 54 positioned between the upstream portion 32 and the downstream portion 34. The air blower 54 is configured to urge the combustion products (emanating from the combustion chamber 44) from the upstream portion 32 to the downstream portion 34.

A series of baffles 70 are positioned along the length of the upstream and downstream portions 32 and 34. The baffles 70 promote turbulence of the combustion products flowing therethrough. Increased turbulence of the combustion products produces greater heat transfer between the combustion products and the water within the water tank 22. The number and arrangement of baffles 70 can be modified to optimize the efficiency of the water heater 15.

The air blower 54 is configured to draw combustion products through the upstream portion 32 and deliver combustion products through the downstream portion 34 to facilitate both passes of the combustion products through the water tank 22. In operation, the air blower 54 maintains a negative pressure (with respect to atmospheric pressure) within the upstream heat exchange portion 32 to urge the products of combustion from the combustion chamber 44 into the upstream portion 32. The air blower 54 also maintains a positive pressure (with respect to atmospheric pressure or the pressure within the upstream heat exchange portion 32) within the downstream portion 34 to urge the products of combustion through the downstream portion 34.

Figure 6:
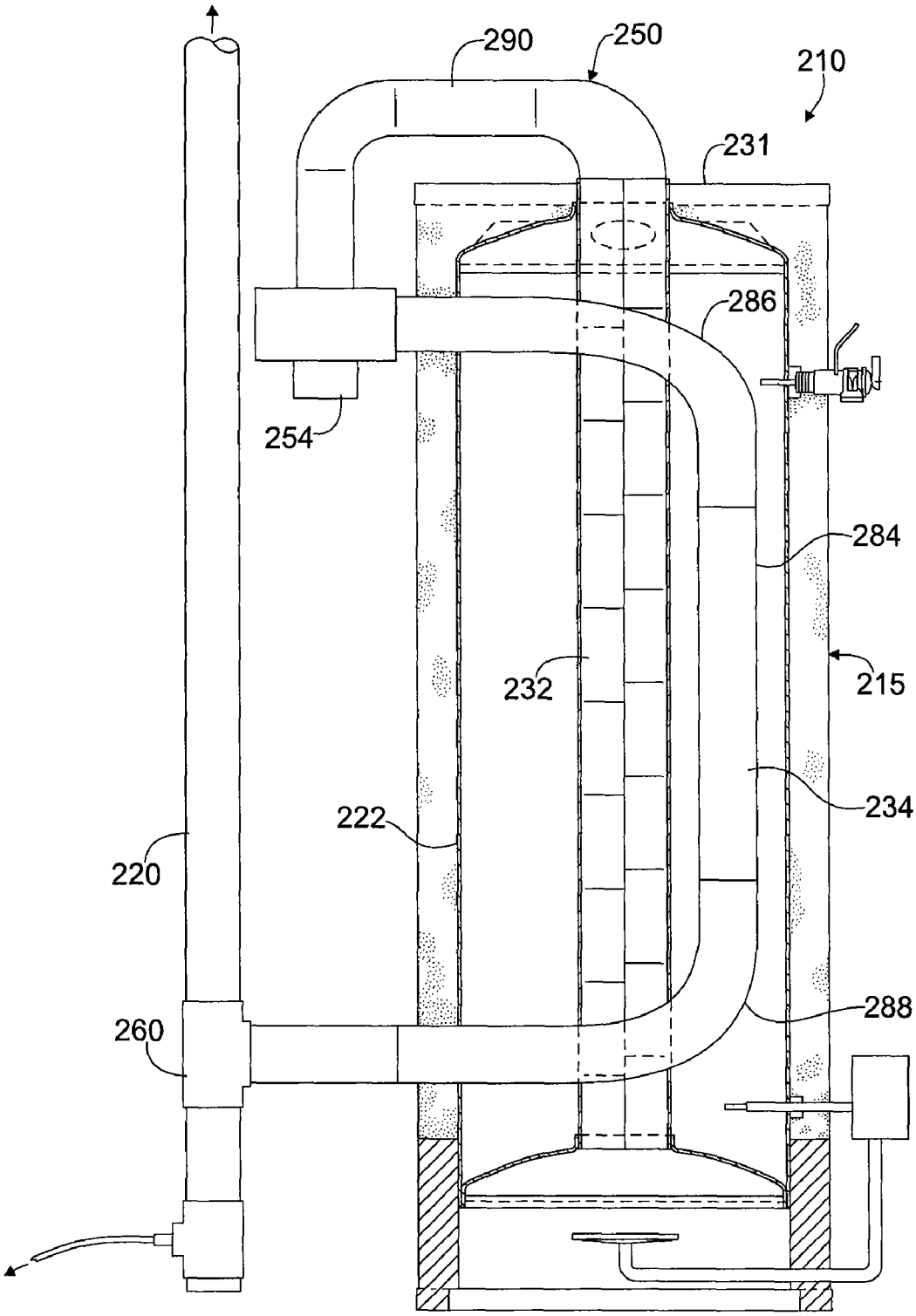
FIG. 6 is a partial cross-sectional side elevation view of another exemplary embodiment of a water heating system according to aspects of this invention.

The air blower 54 includes an inlet port 52 for coupling with the upstream portion 32, an outlet port 56 for coupling with the downstream portion 34, and an internal impeller (not shown) for urging the flow of combustion products from the inlet port 52 to the outlet port 56 of the air blower 54. The air blower 54 is optionally positioned at an elevation above or coincident with the top end 31 of the water heater 15. However, the air blower 54 may be positioned at any particular elevation, as shown in FIG. 6. A suitable air blower 54 is manufactured and distributed by the Fasco Corporation, a division of Regal Beloit of Beloit, Wis.

The flue system 50 is configured to limit condensation of the combustion products until the combustion products reach the downstream heat exchange portion 34. Specifically, the blower 54 substantially reduces the formation of condensation on the surfaces of the burner 40 and the upstream portion 32 by urging the combustion products through the upstream portion 32 at a relatively high velocity. In the absence of a blower, condensation is more likely to collect on the surfaces of the burner 40 and the downstream portion 32. As described in the Background section, the formation of acidic condensate, even in relatively small quantities, can accelerate the corrosion of heat exchange tubing, increase oxidation and scale formation, reduce heat exchange efficiency and contribute to failure of the water heater.

Delaying condensation of the combustion products until the combustion products reach the downstream heat exchange portion 34 provides for more consistent and reliable operation of the water heater 15. As the combustion products travel downward through the downstream heat exchange portion 34, the temperature of the combustion products continues to decrease until the temperature is equal to that of the water contained with in the storage tank 22. Water vapor contained within the combustion products condenses once the temperature of the combustion products is equal to that of the dew point of the combustion products.

A number of variables may be controlled to limit the formation of condensation on the burner 40 and the downstream portion 32, including, but not limited to: the hourly input (i.e., the rate at which fuel is combusted in units such as cubic feet per hour), the surface area of the heat exchange portions 32 and 34, the pressure drop through the flue system 50, and the speed of the air blower impeller.

In operation, condensation flows through the downstream heat exchange portion 34 under gravity. Accordingly, the entire length of the upstream portion 34, or a significant portion thereof, is downwardly sloping to facilitate the flow of condensate under gravity. The condensation then travels into the collection device 60 of the exhaust conduit 20. The collection device 60 is configured to separate condensation and combustion gases. The condensate collects in a container 63, and drains through a tube 64 under gravity. The combustion gases are ultimately exhausted through an outlet port 62 of the exhaust conduit 20.

According to one aspect of the invention, the upstream heat exchange portion 32 is a hollow tube of circular cross-section extending along the entire height of the water tank 22 between the inlet port 52 of the air blower 54 and the combustion chamber 44. The upstream portion 32 provides a first pass for heat exchange of the combustion products with water in the water tank 22. The upstream heat exchange portion 32 may be also commonly referred to in the art as a 'flue tube.'

The upstream heat exchange portion 32 is positioned within the interior of the water tank 22 and may be substantially aligned with the longitudinal axis of the water tank 22, as shown. Alternatively, depending upon the location of the air blower 54, the upstream heat exchange portion 32 may be positioned in any other orientation within the water tank 22, such as horizontal, for example. It should be understood that the position and orientation of the upstream heat exchange portion 32 is not limited to that shown and described herein, as the upstream heat exchange portion 32 may be positioned in any other orientation within the water tank 22.

The upstream portion 32 may be a substantially straight tube, as shown. According to one aspect of the invention, the outer diameter of the upstream heat exchange portion 32 may be between 2 inches and 8 inches, more preferably between 4 inches and 6 inches and most preferably about 5 inches. The length of the upstream portion 34 may be between 20 inches and 80 inches, more preferably between 35 inches and 65 inches and most preferably between 45 inches and 50 inches.

The shape, size and number of upstream heat exchange portions may vary from that disclosed herein. Alternative upstream heat exchange portion routings could be vertically aligned with and offset from the water tank axis or diagonally aligned through the tank head and tank base of the water tank. In another embodiment, the upstream heat exchange portion 32 can take the form of a coil having any number of geometrical cross-sections. A helically shaped upstream portion may offer a relatively larger heat exchange area between the water in the water tank 22 and the combustion products. The baffles 70 may be positioned along the length of the upstream portion, regardless of its overall size, shape (e.g., straight or coiled) or cross-sectional shape (e.g., circular or square).

According to one aspect of the invention, the downstream heat exchange portion 34 is a hollow tube of circular cross-section extending between the outlet port 56 of the air blower 54 and the exhaust conduit 20 for providing a second pass for heat exchange of the combustion products with water in the water tank 22.

The downstream heat exchange portion 34 includes a substantially straight segment that is oriented substantially parallel to the upstream heat exchange portion 32, and a semi-helical segment 69 that is positioned to encircle or extend about the upstream heat exchange portion 32. Because neither the substantially straight segment nor the semi-helical segment 69 of the downstream portion 34 are substantially horizontal, the condensate may drain along the entire length of the upstream portion 34 under gravity. It should be understood that the position and orientation of the downstream heat exchange portion 34 is not limited to that shown and described herein, as the downstream heat exchange portion 34 may be positioned in any other orientation within the water tank 22.

The downstream heat exchanger provides sufficient surface area to transfer heat, and the interior diameter of the heat exchanger is preferably large enough to accommodate a baffle (such as baffle 70 of FIG. 2) to promote heat exchange.

The trajectory of the curved downstream heat exchange portion is tailored to provide sufficient clearance between the heat exchange portion and at least one sacrificial anode rod and the inlet diptube to prevent erosion of a protective enamel coating covering the heat exchange portion. Furthermore, the trajectory of this heat exchange portion is also tailored to clear the gas valve thermocouple that is used to sense the temperature of the water contained within the tank, and the temperature sensing probe of a temperature and pressure relief valve. The foregoing positional relationships are beneficially maintained within the generally cylindrical structure of a tank having an external diameter between 10 and 30 inches, or more preferably between 14 and 22 inches, and most preferably about 18 inches.

The semi-helical segment 69 extends outside of the water heater 15 through an aperture provided in the water tank 22 and the outer shell 24 for connection with the collection device 60 of the exhaust conduit 20. The exit point of the semi-helical segment 69 is in close proximity to the bottom of the tank 22.

The shape, size, orientation and number of downstream heat exchange portions may vary from that disclosed herein. More particularly, both the upstream and downstream heat exchange portions 32 and 34 could consist of multiple tubes. The number of upstream and downstream heat exchange portions 32 and 34 need not be equal. Nevertheless, it is preferred to distribute the heat exchange surface area along the heat exchange portions 32 and 34 such that the temperature of the combustion products is reduced to a point below the dew point of the combustion products. The baffles 70 may be positioned along the length of the downstream portion 34, regardless of its overall size, shape (e.g., straight or coiled) or cross-sectional shape (e.g., circular or square).

According to one aspect of the invention, the outer diameter of the downstream heat exchange portion 34 may be between ½ inch and 5 inches, more preferably between 2 inches and 4 inches, or most preferably about 3 inches. The length of the downstream portion 34 may be between 20 inches and 200 inches, more preferably between 40 inches and 120 inches and most preferably 70 inches. Although only one downstream heat exchange portion 34 is shown, the flue system 50 may contain any number of downstream heat exchange portions.

The ratio of the surface area of the downstream portion 34 to that of the upstream portion 32 may also be tailored to optimize the efficiency of the water heater. For example, the ratio can be adjusted by modifying the size and/or number of tubes in each of the heat exchange portions 32 and 34. In one exemplary embodiment, the ratio of the surface area of the downstream heat exchange portion 34 to that of the upstream heat exchange portion 32 is maintained between about 1.1:1 and about 4:1, more preferably between about 1.3:1 and 2:1 and most preferably about 1.5:1. Other ratios may be acceptable as well. As discussed in greater detail later, the surface area of the downstream heat exchange portion 34 necessary to promote condensation of water vapor contained in the combustion gases is nearly equal to, or perhaps greater than the surface area of the upstream heat exchange portion 32.

According to one aspect of the invention, the upstream portion 32 removes significantly more heat from the combustion gases than the downstream portion 34. For example, the upstream portion 32 might receive combustion gases at about 2500° F. and the combustion gases might exit the upstream portion 32 at about 300° F. The downstream portion 34 might receive the combustion gases at about 300° F. and the combustion gases might exit the downstream portion 34 at about 110° F. The preferred temperature of combustion gases exiting the downstream portion is less then the average temperature of the water contained in the tank. For example, the average temperature of the water contained within the tank might be 135° F. and the combustion gases exiting the downstream portion 34 might be 125° F. This is achievable by delivering the incoming water from the diptube to the lowest portion the tank, thereby surrounding the semi-helical portion of the downstream portion, the tank base and at least a portion of the upstream portion in the coldest water within the tank.

Figure 3:
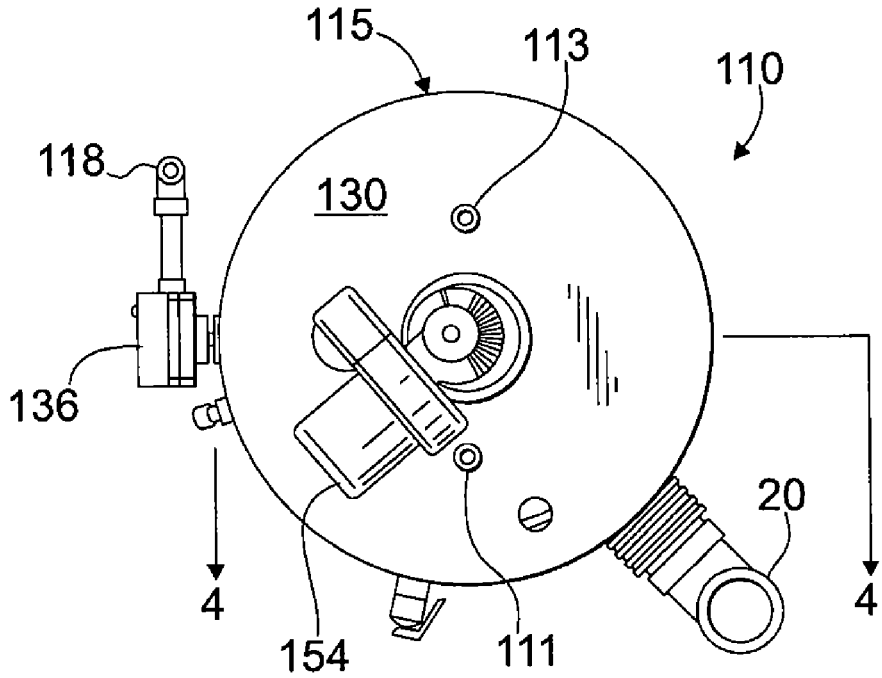
FIG. 3 is a top plan view of an exemplary embodiment of another water heating system according to aspects of this invention.
Figure 4:
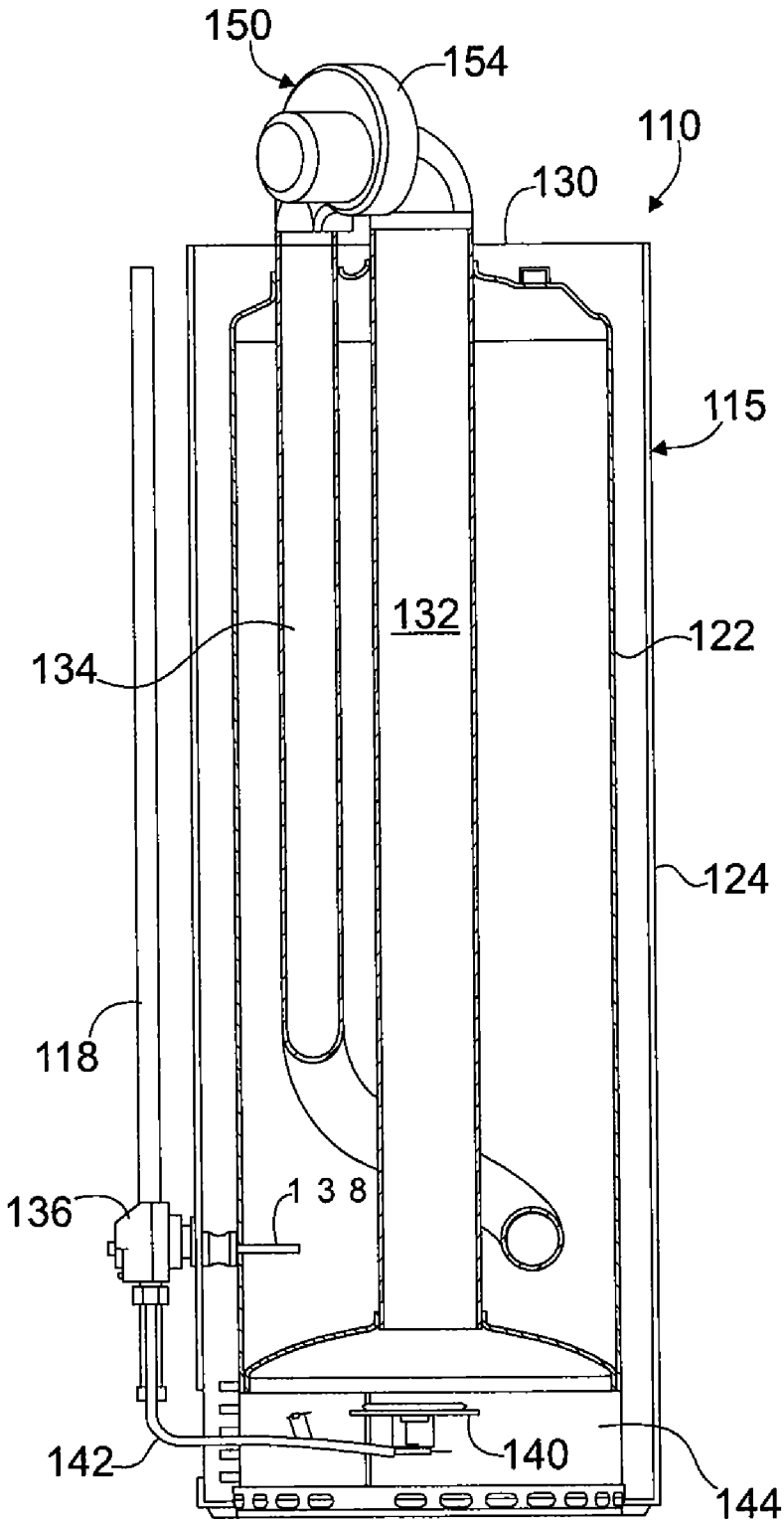
FIG. 4 is a partial cross-sectional side elevation view of the water heating system illustrated in FIG. 3 taken along the lines 4-4 of FIG. 3.
Figure 5:
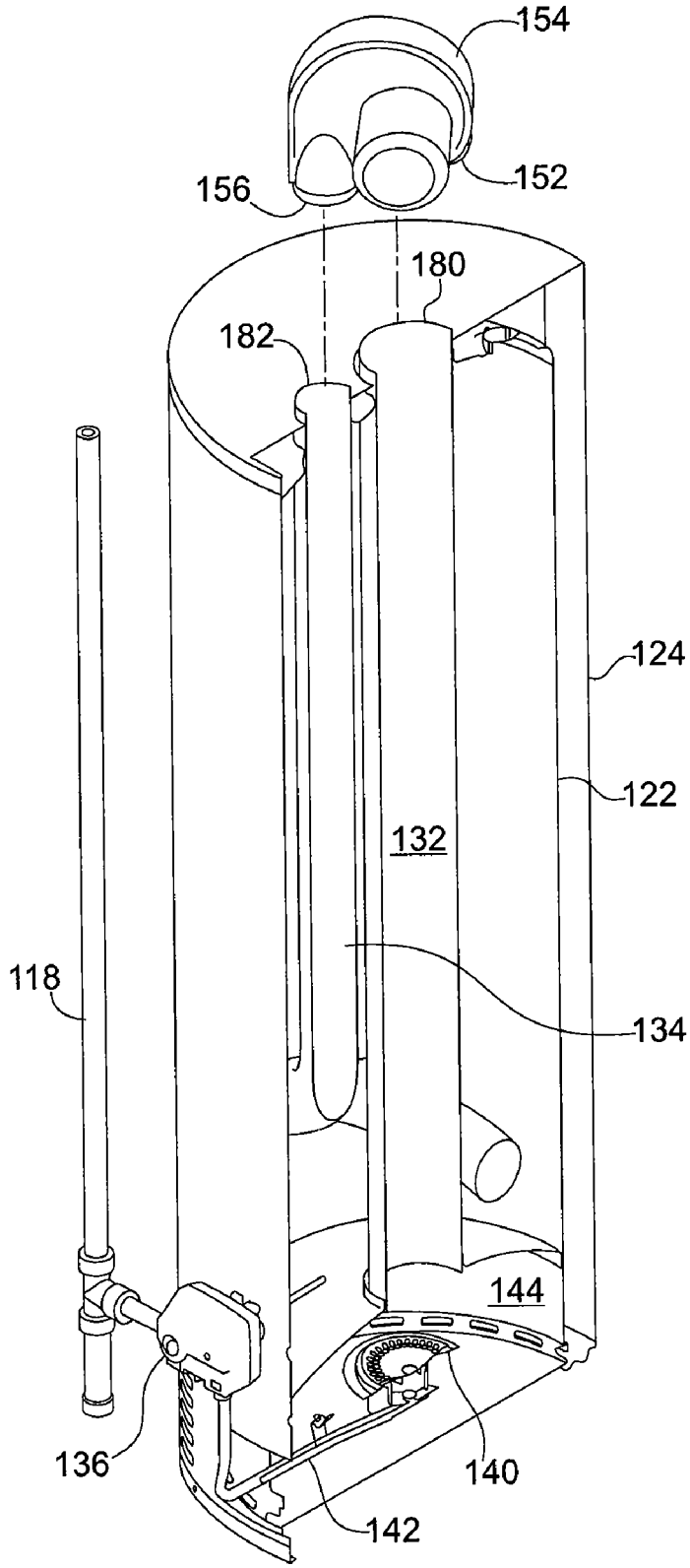
FIG. 5 is a partial cross-sectional perspective view of the water heating system of FIG. 4 where the air blower is shown separated from the water heating system.

FIGS. 3-5 depict another exemplary embodiment of a water heating system 110 including a water heater 115. The water heater 115 illustrated in FIGS. 3-5 is substantially similar to the water heater 15 shown in FIGS. 1 and 2, with the exception of the position of the downstream portion 134 within the water tank 122. Additionally, unlike the water heating system of FIGS. 1 and 2, an exhaust conduit is omitted and a gas supply line 118 is included in FIGS. 3-5.

The water heater 115 includes a water tank 122 for containing water, an outer shell 124 for encapsulating the water tank 122, and a flue system 150 for distributing combustion products for heat exchange with water in the water tank 122. A top cover 130 is fastened to the outer shell 124, thereby enclosing the top surface of the water storage tank 122. The top cover 130 includes apertures for accommodating the flue system 150, a cold water inlet port 111 and a hot water outlet port 113.

The gas-fired water heater 115 includes a control unit 136 having a gas valve and thermostat. The control unit 136 includes an inlet for receiving gas from a gas supply line 118, and a thermocouple 138 extending into the water that measures the water temperature inside the water tank 122. The gas burner 140 receives gas via a conduit 142. The gas burner 140 is positioned in a combustion chamber 144 that is disposed at an elevation beneath the water storage tank 122.

Similar to the flue system 50 depicted in FIG. 2, the flue system 150 includes an upstream heat exchange portion 132 providing a first pass for heat exchange with water in the water tank 122, a downstream heat exchange portion 134 providing a second pass for heat exchange with water in the water tank 122, and a blower 154 positioned between the upstream portion 132 and the downstream portion 134.

As shown in FIG. 5, the air blower 154 includes an inlet port 152 for connection to the outlet end 180 of the upstream heat exchange portion 132, an outlet port 156 for connection to the inlet end 182 of the downstream heat exchange portion 134, and an internal impeller for urging combustion products from the upstream portion 132 to the downstream portion 134.

FIG. 6 depicts another exemplary embodiment of a water heating system 210 including a water heater 215. The water heater 215 illustrated in FIG. 6 is substantially similar to the water heater 15 of FIG. 1, and operates under the same principles. Unlike the water heater 15 depicted in FIGS. 1 and 2, however, the air blower 254 of the water heater 215 is positioned at an elevation beneath the top surface 231 of the water heater 215. Positioning the air blower 254 beneath the top surface 231 of the water heater 215 reduces the overall height of the water heater, and improves manufacturability of the tank.

The water heater 215 includes a "two-pass" flue system 250 at least partially positioned within the water tank 222. The flue system 250 includes an upstream heat exchange portion 232 providing a first pass for heat exchange with water in the water tank 222, a downstream heat exchange portion 234 providing a second pass for heat exchange with water in the water tank 222, and a blower 254 positioned between the upstream portion 232 and the downstream portion 234.

The downstream portion 234 includes a semi-helical segment 286 extending from the air blower 254, a second semi-helical segment 288 extending from the exhaust conduit 220, and a substantially straight segment 284 extending between the semi-helical sections 286 and 288. The substantially straight segment 284 is entirely positioned within the water tank 222, whereas a portion of the semi-helical segments 286 and 288 are positioned within the water tank 222. The remaining portions of each of the semi-helical segments 286 and 288 are positioned outside of the water heater 215 for connection to the air blower 254 and the collection device 260 of the exhaust conduit 220, respectively. The water tank 222 and the outer shell 224 both include apertures to accommodate the semi-helical segments 286 and 288.

Unlike the upstream heat exchange portion 32 of FIG. 1, the upstream heat exchange portion 232 of FIG. 6 extends outside of the water heater 215 and includes a u-shaped segment 290 extending between the top surface 231 of the water heater 215 and the inlet port of the air blower 254.

Figure 7A:
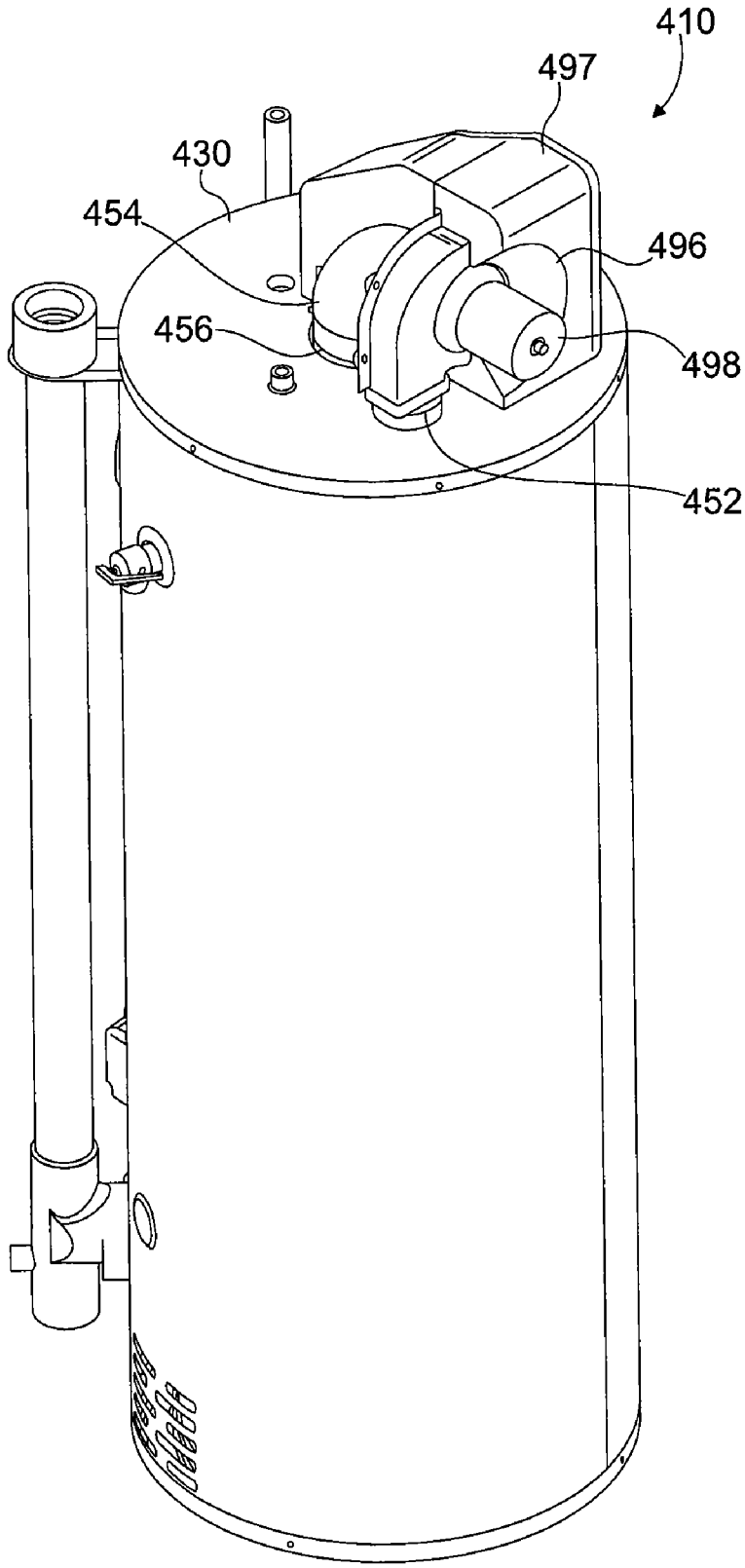
FIGS. 7A and 7B depict perspective views of yet another exemplary embodiment of a water heating system according to aspects of this invention, wherein the water heating system includes a thermal insulator positioned over the air blower.
Figure 7B:
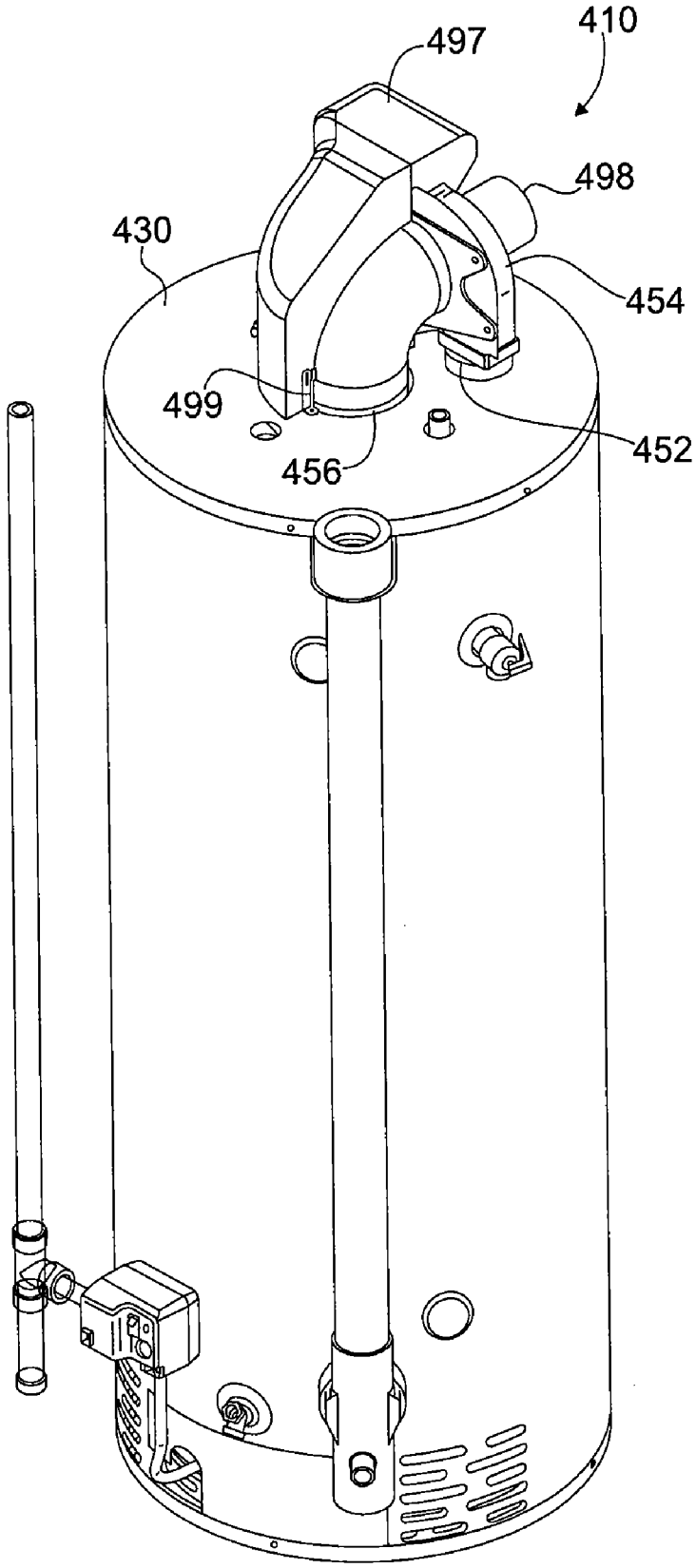

FIGS. 7A and 7B depict perspective views of a residential water heating system 410. The system 410 is tailored to address a problem of a unique water heater structure including a blower which receives and impels hot gas. The system 410 is substantially similar to system 10 of FIG. 1 (i.e., it includes a "two-pass" flue system), with the exception that system 410 includes a thermal insulator 497 positioned over at least a portion of the air blower 454 for thermally insulating the blower. In FIGS. 7A and 7B, the thermal insulator 497 is partially cut-away to reveal the details of the air blower 454. Accordingly, although not shown, the thermal insulator 497 may encapsulate the entire portion of the air blower 454 residing above the top cover 430 of the water heating system 410.

The thermal insulator 497 is positioned to thermally insulate the components of the air blower 454 positioned above the top cover 430 of the water heater. Additionally, the thermal insulator 497 is also positioned to thermally insulate the transition components (not shown, but may be a clamp, for example) coupled between the inlet port 452 of the blower 454 and the upstream heat exchange portion, as well as the transition components (not shown, but may be a clamp, for example) coupled between the outlet port 456 of the blower 454 and the downstream heat exchange portion.

Positioning a thermal insulator 497 over the air blower 454 greatly improves the thermal efficiency of the residential water heating system 410. More particularly, the components of the air blower 454 and the aforementioned transition components are optionally composed of materials having a high thermal conductivity, such as steel, for example, suitable for the transfer of hot flue gases from the upstream heat exchange portion to the downstream heat exchange portion. It is contemplated that the temperature of the hot flue gases may exceed the safe operating limits of many plastic materials (a common material of air blower components).

The thermally conductive components of the air blower 454 and the aforementioned transition components dissipate heat both during burner operation and during burner standby periods. Dissipation of heat through the air blower reduces the thermal efficiency of a water heating system. To counteract thermal efficiency losses, a thermal insulator 497 is positioned over at least a portion of the air blower 454. The thermal insulator 497 is configured to reduce the dissipation of heat from the air blower 454 and the air blower transition components. The thermal insulator 497 is composed of insulative materials, such as fiberglass, high-density rigid polyurethane, or both, for example, or any other thermally insulative material known to those skilled in the art.

Surrounding the exposed, thermally conductive, components of the air blower 454 with the thermal insulator 497 increases the heat contained within the residential water heating system 410, and reduces the heat dissipated by the residential water heating system 410 to the atmosphere. Insulating the air blower 454 enhances the natural heat trapping effect of the air blower 454. The natural heat trapping effect of the air blower 454 combined with the insulation benefits conferred by the thermal insulator 497 greatly improves transfer of heat to the water within the water tank during burner operation, and significantly reduces heat loss during periods when the air blower 454 is not actively operating.

The thermal insulator 497 is optionally composed of two half sections (only one section is illustrated in FIGS. 7A and 7B). Each section of the thermal insulator 497 is fixedly connected to the top cover 430 by one or more "L"-shaped brackets 499. Although not shown, fasteners may be employed to couple the respective ends of the brackets 499 to the top cover 430 and the thermal insulator 497. The brackets 499 may also be adhered to both the top cover 430 and the thermal insulator 497 by an adhesive, for example. Those skilled in the art will recognize that numerous ways of attaching the thermal insulator 497 to the system 410 exist.

The thermal insulator 497 includes an opening 496, a portion of which is illustrated in FIG. 7A, for accommodating the inducer motor 498 of the air blower 454 and exposing the inducer motor 498 to atmospheric, ambient air. The opening 496 may also be referred to herein as an air vent. By providing an opening 496 in the thermal insulator 497, the inducer motor 498 is neither covered nor insulated by the thermal insulator 497. Covering the inducer motor 498 with insulation could potentially result in overheating and/or failure of the inducer motor 498. The opening 496 of the thermal insulator 497 promotes cooling of the inducer motor 498 by isolating the inducer motor from surrounding insulation and providing direct access to ambient air. Moreover, the opening 496 of the thermal insulator 497 maintains a lower temperature of the inducer motor 498 through unrestricted access to ambient air, thereby enhancing the performance and reliability of the air blower 454, as well as extending the useful life of the air blower 454.

Figure 8:
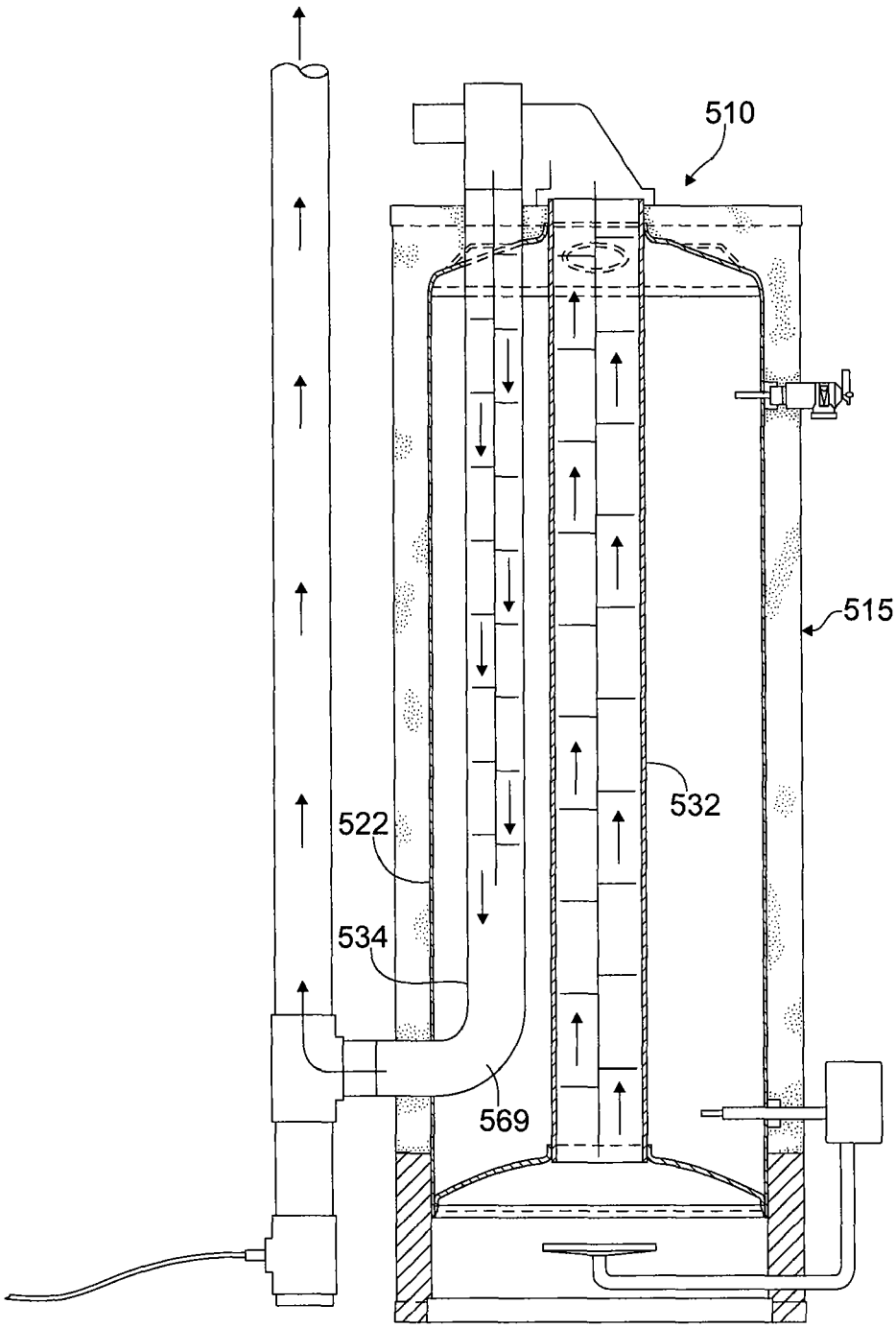
FIG. 8 is a partial cross-sectional side elevation view of still another exemplary embodiment of a water heating system according to aspects of this invention.
Figure 9:
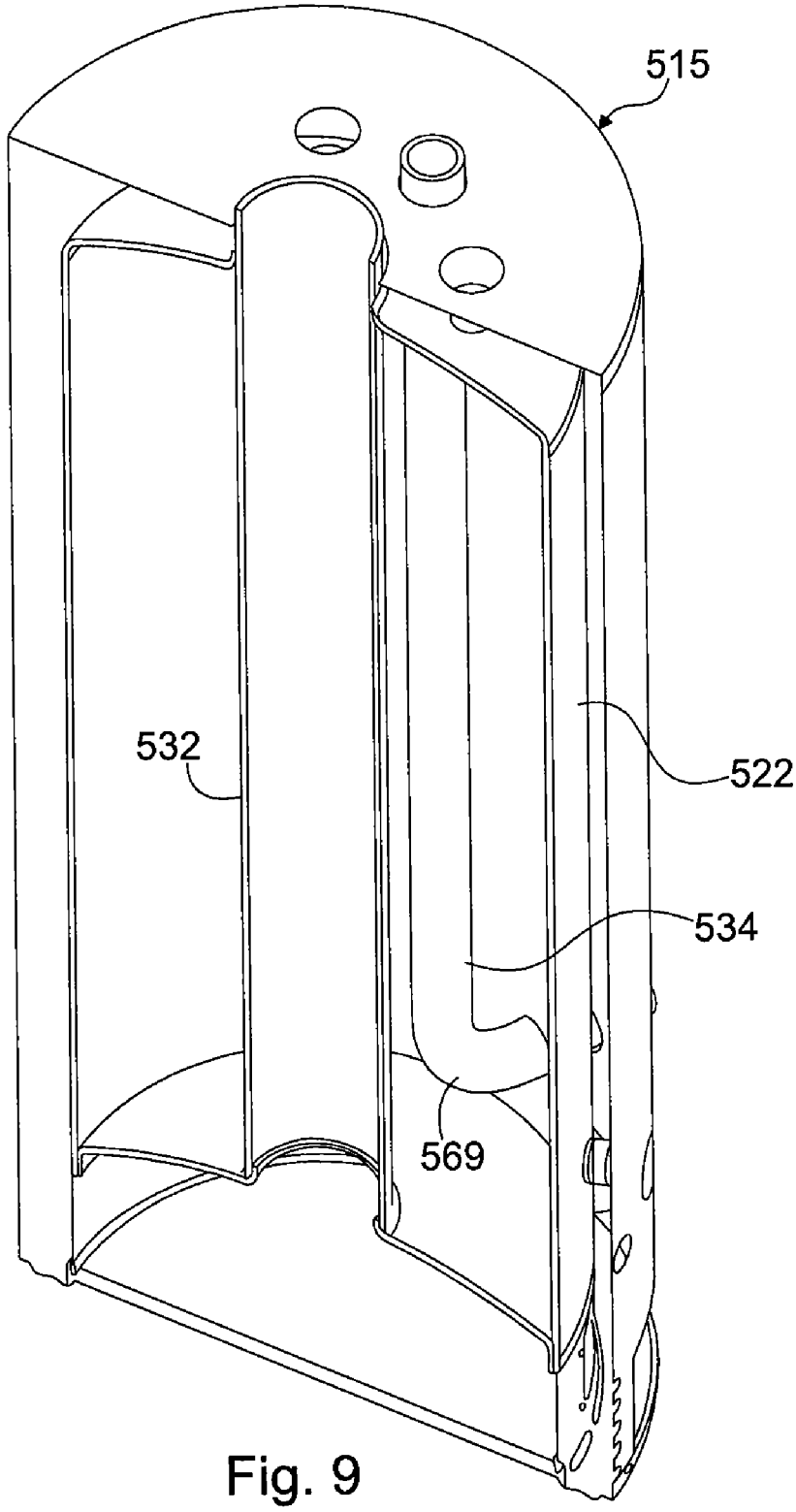
FIG. 9 is a cross-sectional perspective view of the water heater illustrated in FIG. 8 (blower and gas burner omitted).

FIG. 8 depicts another exemplary embodiment of a water heating system 510 including a water heater 515. A cross-sectional view of a portion of the water heater 515 is illustrated in FIG. 9. Arrows in FIG. 8 indicate the flow of combustion products through the heat exchange system 510. The water heater 515 illustrated in FIGS. 8 and 9 is substantially similar to the water heater 15 of FIG. 2, and operates under the same principles. Unlike the water heater 15 depicted in FIG. 2, however, the downstream heat exchange portion 534 includes a bent segment 569 in lieu of a helical segment. The bent segment 569 may comprise, for example, a 90 degree bend, as shown. By way of non-limiting example, the outer diameter of the downstream heat exchange portion 534 may be about 3 inches.

The bent segment 569 extends outside of the water heater 515 through an aperture provided in the water tank 522 and the outer shell for connection with the collection device of the exhaust conduit. The exit point of the bent segment 569 is in close proximity to the bottom of the tank 522.

Example

A water heater corresponding to the exemplary embodiment illustrated in FIG. 7A was built and tested to determine its thermal performance. The results of the five tests, labeled Examples 1-5, are summarized in Table #1.

TABLE #1

Thermal Performance Measurements

| Example No. | Tank Capacity (gal) | Time of Burner Operation (min) | Starting Tank Temp (° F.) | Average Upstream Flue[1] Outlet Temp (° F.) | Downstream Flue[2] Outlet Temp (° F.) | Average Tank Temp (° F.) | Average Temp Increase (° F.) | $CO_2$ Level (%) | CO Level (ppm) | COaf (ppm)[3] | Burner Input (btu/hr) |
|---|---|---|---|---|---|---|---|---|---|---|---|
| 1 | 46 | 15 | 70 | 269 | 108.1 | 101.8 | 31.8 | 10.5 | 20 | 32.2 | 50,026 |
| 2 | 46 | 15 | 69.5 | 262 | 108.5 | 102 | 32.5 | 10.5 | 25 | 29 | 51,005 |
| 3 | 46 | 15 | 70.1 | 259 | 109.2 | 101.6 | 31.5 | 10.2 | 20 | 23.9 | 49,987 |
| 4 | 46 | 15 | 69.9 | 266 | 108.4 | 101.9 | 32 | 10.3 | 20 | 23.7 | 49,559 |
| 5 | 46 | 15 | 69.8 | 263 | 108.6 | 102.1 | 32.3 | 10.2 | 20 | 23.9 | 50,545 |

[1]The 'upstream flue' refers to the upstream heat exchange portion 32 of FIG. 2. The outlet of the upstream heat exchange portion 32 is coupled to the inlet port (item 152 of FIG. 5) of the air blower (item 154 of FIG. 5). The temperature reading was taken at the outlet of the upstream heat exchange portion 32.
[2]The 'downstream flue' refers to the downstream heat exchange portion 34 of FIG. 2 The outlet of the downstream heat exchange portion 34 is coupled to the exhaust conduit (item 20 of FIG. 1). The temperature reading was taken at the outlet of the downstream heat exchange portion 34.
[3]The term 'COaf' denotes the amount of Carbon Monoxide (i.e., CO) in an air free sample of combustion gases.

The results of the test indicate a significant transfer of heat from the combustion gases through the heat exchanger material and into the water contained within the tank at a low Carbon Monoxide emission level.

The thermal efficiency of the water heater illustrated in FIG. 7A is well above the typical thermal efficiency of conventional gas-fired, tank-style water heaters. The thermal efficiency of the water heater of FIG. 7A was determined by measuring several variables, as shown in Table #2 below, and inputting those measurements into a thermal efficiency formula, as described hereinafter.

TABLE #2

Measured Quantities

| Measured Quantity | Value | Units |
|---|---|---|
| Heating Value | 1026 | Btu/ft^3 |
| Barometric Pressure | 29.47 | in mm |
| Mean Gas Temperature | 72.7 | ° F. |
| Gas Pressure @ Exit of Gas Valve | 4 | in. water column (W.C.) |
| Gas Pressure @ Location Between Pressure Regulator and Gas Valve | 7 | in. W.C. |
| Gas Consumed by Water Heater over 30 minute Period | 24.4 | ft.^3 |
| Water Expelled over 30 minute Period | 305 | lb. |
| Average Outlet Water Temp. | 140.6 | ° F. |
| Average Inlet Water Temp. | 68.4 | ° F. |

After taking the measurements reported in Table #2, a "Correction Factor" accounting for gas pressure, barometric pressure and gas temperature was calculated using Equation #1 below.

$$\text{Correction Factor} = \frac{\left(\begin{array}{c}\text{Barometric Pressure} + \\ \text{"Gas Pressure @ Location"}\end{array}\right) * 520}{(\text{Mean Gas } \textit{Temp.} + 460) * 30} \quad \text{(Eq. 1)}$$

After determining the "Correction Factor", the thermal efficiency of the water heater of FIG. 7A was calculated using Equation #2 below. For reference, the "Temp. Change" listed in Equation #2 is the difference between the "Average Outlet Water Temp" and the "Average Inlet Water Temp" values reported in Table #2.

$$\text{Thermal Efficiency} = \frac{\begin{array}{c}(\text{Water Expelled}) * \\ (\textit{Temp.}\ \text{Change})\end{array}}{\begin{array}{c}(\text{Heating Value}) * \\ (\text{Gas Consumed}) * \\ (\text{Correction Factor})\end{array}} \quad \text{(Eq. 2)}$$

Substituting the values listed in Table #2 into Equation #2 yields a thermal efficiency of 92.5%. The calculated thermal efficiency of 92.5% is well above the typical thermal efficiency of conventional gas-fired, tank-style water heaters, which is reportedly 77%. The improved thermal efficiency of the water heater of FIG. 7A is believed to result from features including the unique two-pass flue system (items 50, 150 and 250) depicted in the figures and the thermal insulator (item 497 of FIGS. 7A and 7B).

For reference, in Table #2, the "Heating Value" was determined by a calorimeter, which measures how much heat is contained in 1 ft^3 of gas. The term "Heating Value" may also be referred to as a calorific value. The Barometric Pressure was measured by a barometer positioned adjacent the water heater. The "Gas Pressure @ Exit of Gas Valve" was measured by a pressure gauge positioned at the exit of the gas valve. The gas valve was positioned within the interior of the control unit 36 shown in FIG. 2. The "Gas Pressure @ Location Between Pressure Regulator and Gas Valve" was measured by a pressure gauge positioned at a location between the gas valve the pressure regulator. The pressure regulator was positioned upstream of the gas valve, but is not depicted in the Figures. The "Gas Consumed by Water Heater over 30 minute Period" was measured by a conventional gas meter over a period of 30 minutes. The weight of the "Water Expelled by Water Heater over 30 minute Period" was measured by a weight scale. More specifically, hot water was delivered from the hot water outlet port (item 13 of FIG. 1) into an empty barrel over a 30 minute period. The empty barrel was first weighed before the 30 minute test period and was weighed again after being filled with hot water over a 30 minute period. The difference between those weight measurements was reported in Table 2.

The "Average Water Inlet Temp." was periodically measured using a thermometer positioned at the cold water inlet port (item 11 of FIG. 1) of the water heater, and the average of those measurements over a 30-minute period was reported in Table 2. The "Average Water Outlet Temp." was periodically measured using a thermometer positioned at the hot water outlet port (item 13 of FIG. 1) of the water heater, and the average of those measurements over a 30 minute period was reported in Table 2.

The combustion efficiency of the water heater illustrated in FIG. 7A is also well above the typical combustion efficiency of conventional gas-fired, tank-style water heaters. The term 'combustion efficiency' is a measure of the percentage of total energy that escapes from the water heater. One method of calculating the combustion efficiency is to compare the theoretical amount of condensation produced by a water heater with the measured amount of condensate produced by a water heater. Several steps and measurements were generally used to determine the combustion efficiency of a water heater, as described hereinafter.

The stoichiometric combustion equation for burning a natural gas in the presence of air is shown below in Equation #3.

$$CH_4+2O_2+2(3.76)N_2 \rightarrow CO_2+2H_2O+2(3.76)N_2 \quad \text{(Eq. 3)}$$

To promote complete combustion of the gas, combustion chambers are typically supplied with excess air. Excess air increases the amount of oxygen thereby increasing the probability of combustion of all of the gas supplied to the burner. The water heater of FIG. 7A was operated at 15% excess air (a measured quantity) to promote complete combustion of the gas fuel. The stoichiometric combustion equation (i.e., Equation #3) does not account for excess air. A balanced combustion equation accounting for 15% excess air is shown below (i.e., Eq. 4).

$$CH_4+2.1699O_2+8.158N_2 \rightarrow CO_2+2H_2O+0.1699O_2+8.159N_2 \quad \text{(Eq. 4)}$$

According to Table #4 shown below, the total molecular mass of the product side of the equation is 314 grams and the total mass of water is 36 grams. Thus, the percentage of water by mass is 11.47%.

TABLE #4

Molecular Mass Computations
Product Side of Equation #4

| Molecule | Mass of molecule (g) | Molecules | Molecular Mass (g) | % Composition |
|---|---|---|---|---|
| $CO_2$ | 44 | 1 | 44 | 14.02% |
| $H_2O$ | 18 | 2 | 36 | 11.47% |
| $O_2$ | 32 | 0.17 | 5.44 | 1.73% |
| $N_2$ | 28 | 8.16 | 228.45 | 72.78% |
| | | Totals | 313.89 | 100.00% |

Over the course of the testing period, the consumption rate of natural gas (composed primarily of methane) was 2.228 lb/hour. The consumption rate may be defined as the quotient of the average burner input (see Table #1) and the heating value of natural gas (see Table #1). Over the course of the testing period, the consumption rate of air was 39.761 lb/hour. The sum of the consumption rate of both natural gas (i.e., $CH_4$) and air was 41.898 lb/hour. The product of the percentage of water by mass (11.47%) and the total consumption rate of both methane and air (41.898 lb/hour) yields a theoretical rate of condensate over the test period of 4.816 lb/hour. In comparison, the measured rate of condensate over the test period was 2.238 lb/hour.

The formula for determining the combustion efficiency is shown below in Equation #5. Substituting the above-reported values of the measured rate of condensate and the theoretical rate of condensate into Equation #5 yields a combustion efficiency of 93.041%. A combustion efficiency of 93.041% is well above the typical combustion efficiency of conventional gas-fired, tank-style, water heaters, which is approximately 76% according to the Energy and Environmental Building Association. The improved combustion efficiency of the water heater of FIG. 7A is believed to result from features including the unique two-pass flue system (items 50, 150 and 250) depicted in the figures and the thermal insulator (item 497 of FIGS. 7A and 7B).

$$\text{Combustion Efficiency}=87+(13*\text{Measured Condensate})/(\text{Theoretical Condensate}) \quad \text{(Eq. 5)}$$

Although this invention has been described with reference to exemplary embodiments and variations thereof, it will be appreciated that additional variations and modifications can be made within the spirit and scope of this invention. Although this invention may be of particular benefit in the field of residential water heaters, it will be appreciated that this invention can be beneficially applied in connection with commercial or domestic water heaters and other heating systems as well.

What is claimed is:

1. A water heater having improved heat exchange efficiency, said water heater comprising:
- a water tank;
- a flue system extending at least partially through an interior of said water tank and positioned to receive combustion products and to transfer heat from the combustion products within said flue system to water in said water tank,
- said flue system including
  - an upstream heat exchange portion providing a first pass for heat exchange with water in said water tank,
  - a downstream heat exchange portion providing a second pass for heat exchange with water in said water tank, and
  - a blower positioned between said upstream heat exchange portion and said downstream heat exchange portion, said blower being configured to urge the combustion products from said upstream heat exchange portion to said downstream heat exchange portion.

2. The water heater of claim 1, said upstream heat exchange portion having at least one substantially vertical flue tube.

3. The water heater of claim 2 wherein the at least one substantially vertical flue tube is substantially aligned with a longitudinal axis of the water tank.

4. The water heater of claim 2 wherein the at least one substantially vertical flue tube extends from a top of the water tank to a combustion chamber positioned below the water tank.

5. The water heater of claim 1, said downstream heat exchange portion having at least one substantially vertical flue tube.

6. The water heater of claim 5 wherein the at least one substantially vertical flue tube extends from a top of the water tank to an elevation below the top of the water tank.

7. The water heater of claim 1 wherein said blower is configured to maintain a relatively negative pressure in said upstream heat exchange portion and a relatively positive pressure in said downstream heat exchange portion.

8. The water heater of claim 1 wherein the downstream heat exchange portion terminates at a side of the water tank.

9. The water heater of claim 1 wherein said upstream heat exchange portion of said flue system provides primary heat exchange with water in said water tank, said downstream heat exchange portion of said flue system provides secondary heat exchange with water in said water tank, and said upstream heat exchange portion is configured to transfer more heat to water in said water tank than said downstream heat exchange portion.

10. The water heater of claim 1 wherein the blower is positioned at an elevation above said water tank.

11. The water heater of claim 1 further comprising a combustion chamber positioned adjacent said water tank.

12. The water heater of claim 11 wherein the combustion chamber is positioned at an elevation beneath said water tank.

13. The water heater of claim 1, said flue system defining a passageway between said upstream heat exchange portion and said downstream heat exchange portion, said passageway at least partially extending outside of said water tank.

14. The water heater of claim 1, wherein said blower is positioned outside of said water tank.

15. The water heater of claim 14 further comprising a thermal insulator positioned over at least a portion of said blower for thermally insulating said blower.

16. The water heater of claim 15, wherein the thermal insulator is formed from fiberglass, polyurethane or a combination of fiberglass and polyurethane.

17. The water heater of claim 15, wherein the thermal insulator includes a vent or opening to the atmosphere for cooling a motor of the blower.

18. The water heater of claim 1, said downstream heat exchange portion including a substantially helical section.

19. The water heater of claim 18, said substantially helical section of said downstream heat exchange portion being positioned adjacent a bottom end of said tank.

20. A flue system for a water heater, said flue system comprising:

an upstream heat exchange portion providing a first pass for heat exchange with water in the water heater;

a downstream heat exchange portion providing a second pass for heat exchange with water in the water heater; and a blower positioned between said upstream heat exchange portion and said downstream heat exchange portion, said blower being configured to urge combustion products from said upstream heat exchange portion to said downstream heat exchange portion;

wherein said upstream heat exchange portion of said flue system is sized to provide primary heat exchange with water surrounding the upstream heat exchange portion, said downstream heat exchange portion of said flue system is sized to provide secondary heat exchange with water surrounding the downstream heat exchange portion, and said upstream heat exchange portion is configured to transfer more heat to water than said downstream heat exchange portion.

21. The flue system of claim 20, said upstream heat exchange portion having at least one substantially vertical flue tube.

22. The flue system of claim 20, said downstream heat exchange portion including a substantially vertical section.

23. The flue system of claim 20 wherein said blower is configured to maintain a relatively negative pressure in said upstream heat exchange portion and a relatively positive pressure in said downstream heat exchange portion.

24. The flue system of claim 20, said blower comprising an inlet port coupled to said upstream heat exchange portion and an outlet port coupled to the downstream heat exchange portion.

25. The flue system of claim 24, said blower further comprising an impeller for inducing a flow of combustion gases into said inlet port and distributing combustion gases through said outlet port.

26. A flue system for a water heater, said flue system comprising:

an upstream heat exchange portion providing a first pass for heat exchange with water in the water heater;

a downstream heat exchange portion providing a second pass for heat exchange with water in the water heater; and a blower positioned between said upstream heat exchange portion and said downstream heat exchange portion, said blower being configured to urge combustion products from said upstream heat exchange portion to said downstream heat exchange portion;

further comprising a thermal insulator positioned over at least a portion of said blower for thermally insulating said blower.

27. The flue system of claim 26, wherein the thermal insulator is formed from fiberglass, polyurethane or a combination of fiberglass and polyurethane.

28. The water heater of claim 26, wherein the thermal insulator includes a vent or opening to the atmosphere for cooling a motor of the blower.

29. A method of improving heat exchange efficiency of a water heater having a water storage tank and a combustion chamber positioned adjacent the water storage tank, said method comprising the steps of:

positioning a blower between an upstream heat exchange portion of a flue system positioned at least partially within the water storage tank and a downstream heat exchange portion of a flue system positioned at least partially within the water storage tank;

inducing combustion products to flow from the combustion chamber into the upstream heat exchange portion for exchanging heat between the combustion products and water in the water storage tank; and delivering the combustion products through the downstream heat exchange portion to exchange heat between the combustion products and the water in the water storage tank.

30. The method of claim 29, wherein the step of inducing comprises maintaining a relatively negative pressure within the upstream heat exchange portion.

31. The method of claim 29, wherein the step of delivering comprises maintaining a relatively positive pressure within the downstream heat exchange portion.

32. The method of claim 29 further comprising the step of exhausting the combustion products through an exhaust conduit coupled to the downstream heat exchange portion.

33. The method of claim 32 further comprising the step of separating condensation from the combustion products in the exhaust conduit.

34. The method of claim 29 further comprising the step of positioning a thermal insulator over at least a portion of the blower for thermally insulating the blower.

* * * * *